US009829896B1

(12) United States Patent
Arend et al.

(10) Patent No.: US 9,829,896 B1
(45) Date of Patent: Nov. 28, 2017

(54) PORTABLE ENVIRONMENT CONTROL SYSTEM AND METHOD OF USE

(71) Applicant: Climate Right LLC, Columbus, OH (US)

(72) Inventors: Todd Arend, Columbus, OH (US); James Cline, Jr., Columbus, OH (US); William Jeffrey Schlanger, Palm Springs, CA (US)

(73) Assignee: Climate Right LLC, Columbus, OH (US)

( * ) Notice: Subject to any disclaimer, the term of this patent is extended or adjusted under 35 U.S.C. 154(b) by 744 days.

(21) Appl. No.: 14/269,713

(22) Filed: May 5, 2014

Related U.S. Application Data

(60) Provisional application No. 61/818,942, filed on May 3, 2013.

(51) Int. Cl.
*G05D 23/19* (2006.01)
*F24F 1/02* (2011.01)
*F24F 1/04* (2011.01)

(52) U.S. Cl.
CPC ..... *G05D 23/19* (2013.01); *F24F 1/02* (2013.01); *F24F 1/025* (2013.01); *F24F 1/027* (2013.01); *F24F 1/04* (2013.01)

(58) Field of Classification Search
CPC .... F24F 1/02; F24F 1/025; F24F 1/027; F24F 1/04; G05D 23/19
See application file for complete search history.

(56) References Cited

U.S. PATENT DOCUMENTS 2,708,835 A 5/1955 Nigro
2,760,354 A 8/1956 Brady et al.
2,778,206 A 1/1957 Wilson et al.
3,740,946 A 6/1973 Herweg
3,777,506 A * 12/1973 Hergatt ..... F24F 1/025 62/237
3,855,814 A * 12/1974 Eubank ..... B60H 1/3226 165/42
3,872,686 A 3/1975 Patrie
3,959,985 A 6/1976 Schultze
3,961,496 A 6/1976 Ku
3,964,271 A 6/1976 Schulze
3,964,272 A 6/1976 Raleight et al.
3,996,762 A 12/1976 Calme et al.
(Continued)

*Primary Examiner* — Ryan Reis
(74) *Attorney, Agent, or Firm* — Invention To Patent Services; Alex Hobson

(57) ABSTRACT

A portable environment control system is configured to condition the air within an enclosure, such as by heating, cooling, humidifying or dehumidifying. The portable environmental control system has a conduit that is attached at one end to an environment control device and attached at the opposing outlet end to a partition coupling. The partition coupling is configured over an opening in a partition, such as an exterior wall of a recreation vehicle. Airflow from the environment control device is configured to flow through the conduit and through the partition coupling to an enclosure. The portable environment control system is quick and easy to install and allows for closure of an opening in a partition with a flange cover. The portable environment control system may have an inlet and outlet conduit to provide air flow to and draw air flow from an enclosure, respectively.

18 Claims, 12 Drawing Sheets

(56) References Cited

U.S. PATENT DOCUMENTS

| | | | | | |
|---|---|---|---|---|---|
| 4,362,091 | A | | 12/1982 | Cox | |
| 4,450,900 | A | | 5/1984 | Nathan | |
| 4,632,019 | A | * | 12/1986 | Whiteman | B64F 1/364 454/119 |
| 4,641,503 | A | | 2/1987 | Kobayashi | |
| 5,911,742 | A | | 6/1999 | Akazawa | |
| 6,148,630 | A | * | 11/2000 | Saccone | F24F 1/027 62/259.1 |
| 6,167,714 | B1 | | 1/2001 | Baffes | |
| 7,266,966 | B2 | | 9/2007 | Blackstone | |
| 8,047,555 | B2 | | 11/2011 | Mann, III et al. | |
| 2005/0103370 | A1 | | 5/2005 | Napier | |
| 2007/0068185 | A1 | * | 3/2007 | Thompson | F24F 13/32 62/262 |
| 2008/0264461 | A1 | | 10/2008 | Harris | |
| 2014/0352344 | A1 | * | 12/2014 | Guercio | F24F 13/222 62/291 |

* cited by examiner

PORTABLE ENVIRONMENT CONTROL SYSTEM AND METHOD OF USE

CROSS REFERENCE TO RELATED APPLICATIONS

This application claims the benefit of U.S. provisional patent application No. 61/818,942 filed on May 3, 2013, entitled Portable Environmental Control System and Method of Use, the entirety of which is incorporated herein by reference.

BACKGROUND OF THE INVENTION

Field of the Invention

The present invention relates to portable environment control systems and methods of using said systems.

Background

It is desirable to moderate an enclosure's environment, including the temperature and humidity for the comfort of occupants within the enclosure, or to protect items within the enclosure from damage due to environmental conditions. There are a wide variety of enclosures including recreational vehicles, campers, garages, tents and playhouses that often have no environmental control and can become excessively hot or cold. In many cases, people use these enclosures temporarily and a permanent environmental control system may not be justified. In other cases, an enclosure may only be uncomfortable to occupants during certain times of the day or year. In addition, many of these enclosures may not be able to accommodate a window-unit type air conditioner or other environment control device within an existing opening in the enclosure. Some enclosures are small and locating an environment control device within the enclosure takes up valuable space. Other enclosures may be used primarily to store items, such as sheds, barns, data-centers, electronic enclosures and the like, and excessive hot or cold conditions may lead to damage of items stored therein. Therefore, there is a need for a portable environment control device that is quick and easy to set-up, take-down and that is affordable and convenient.

SUMMARY OF THE INVENTION

The invention is directed to a portable environment control system and method of using said system to control the environmental conditions within an enclosure. In an exemplary embodiment, a portable environment control system, as described herein, comprises an environment control device, such as an air conditioner, having an air inlet and an air outlet duct, a pair of partition couplings, a conduit configured to extend from the air outlet duct to one of the partition couplings and a conduit configured to extend from the air inlet duct to the other partition coupling. In some embodiments, an interior coupling is configured for placement over a partition coupling from the interior of an enclosure. In some embodiments, a conversion cover is configured for attachment to an environment control device and comprises at least one cover coupling, whereby a conduit can be attached to the conversion cover. A conversion cover may comprise one or more conduit couplings and may be configured for attachment to any suitable environment control device including, but not limited to, an air-conditioner, and specifically a window unit type air-conditioner, a heater, a heat-pump, a dehumidifier or any combination thereof. A portable environment control system, as described herein, is quick and easy to use and in some embodiments can be used to convert a standard, low cost, window-unit environment control device into a portable air-conditioning unit.

A portable environment control system, as described herein may be configured for attachment to any suitable enclosure including, but not limited to, recreational vehicles, trailers, emergency response vehicles, heavy-duty trucks, tents, sheds, cabins, garages, playhouses, campers, houses, dog houses, barns, stables, data-centers, electronic enclosures and the like. Some enclosures may be dwellings, or temporary dwellings or shelters for people or animals such as recreational vehicles, trailers, heavy-duty trucks, tents, cabins, garages, playhouses, campers, houses, dog houses, barns and stables. In addition, some enclosures may be mobile, whereby the enclosure is configure for transport, such as recreational vehicles, trailers, emergency response vehicles or heavy-duty trucks. A portable environment control system, as described herein, may be used control the environment of the cabin or other compartment of a vehicle, such as patient treatment portion of an ambulance or other medically oriented vehicle, for example. Still other enclosures may be primarily for storing valuables or equipment, such as data-centers, storage sheds and any other electronic enclosure. Enclosures may have any type of partition separating the interior of the enclosure from the exterior of the enclosure, or in most cases the outside environment. A partition may comprise solid walls, comprising standard building materials, or may comprise a flexible partition, as in the case of a tent where the partition may be a fabric, film, or combination thereof. A partition may be permeable, such as a tent partition, wherein air may flow through the partition.

A conversion cover, as described herein, is configured to be placed over the outlet airflow face of an environment control device, such as an air-conditioner, and covers at least the airflow outlet portion of the environment control device. A conversion cover may be attached to the environment control device using one or more cover retainers, such as a flexible strap that may be pulled and clipped to the back side of the environment control device. Airflow from the environment control device is diverted through the air outlet opening in the cover panel of the conversion cover. The inlet end of a conduit, such as a flexible hose, is connected to a cover coupling portion of a conversion cover. The outlet end of the conduit is attached to a partition coupling. A partition coupling is attached over an opening, or aperture in a partition of an enclosure. For example, a hole may be cut in a partition and a partition coupling may be configured over said partition aperture. In an exemplary embodiment, a partition coupling comprises a partition conduit that extends into the partition opening, and a partition flange retainer having a flange slot configured to receive a conduit flange. An interior coupling may be inserted into a partition opening to provide a partition cover portion on the inside wall of the partition. In an exemplary embodiment, a conversion cover is configured for a window-unit type air-conditioner. In some embodiments, an environment control device comprises an air inlet and air outlet, and a conversion cover is configured with a pair of cover couplings.

A conversion cover is configured for attachment over the airflow outlet of an environment control device and is configured to cover at least a portion of the airflow outlet face of the environment control device. A conversion cover may be attached to an environment control device with one or more retainers, such as elastic straps that can be pulled and clipped to the back of the environment control device.

In one embodiment, four retainer straps are provided; one located approximately at each corner of the cover panel.

A seal may be configured on the backside of the cover panel to substantially seal and effectively direct the airflow from the environment control device through the air outlet opening in the conversion cover. In one embodiment, the conversion cover is configured to substantially cover the entire outlet airflow face of the environment control device and a seal may be configured around the backside of the cover panel, such as along the perimeter. A seal may be any suitable material that compresses to reduce or eliminate airflow through the seal material and includes, but is not limited to, foam, elastomer, fabric, composites, and the like. In one embodiment, a seal material is provided detached from the conversion cover and a user may apply the seal material to the backside of the cover panel, or the airflow outlet face of the environment control device, as required, to seal the airflow outlet when the cover panel is attached. For example, a seal material may be provided with a peel-and-stick adhesive. The seal may be applied to the backside of the cover panel or directly to and around the airflow outlet of the environment control device.

A conversion cover may be configured with an air outlet opening and an air inlet opening. A seal may be provided to effectively seal airflow through these openings. A cover coupling may be configured on one or both of these airflow openings. In still another embodiment, an environment control device comprises an air inlet and air outlet opening, or duct that is configured for attachment of a conduit.

A conversion cover may further comprise control openings whereby a user can manipulate the environment control device controls. In one embodiment, a cover panel comprises break-out portions that are configured for a user to pop-out, or otherwise remove, to create control openings for access to environment control device controls with the conversion cover attached. A cover panel may comprise one or more break-out portions that allow the user to customize their conversion cover for the environment control device unit to which it will be attached.

The conversion cover further comprises a cover coupling that is configured for quick and easy attachment of a conduit. In one embodiment, a cover coupling comprises a cylinder that extends out from the cover panel, whereby a flexible tube type conduit may be slid over the cylinder and retained with a hose clamp, for example. In another embodiment, a cover coupling comprises a cover flange having a flange retainer comprising a flange slot configured for the insertion of a conduit flange. The cover flange may further comprise a flange lock as described herein, whereby the conduit flange is effectively retained in the flange slot.

A partition coupling, as described herein, is configured for coupling a conduit to an opening in a partition. In one embodiment, a partition coupling comprise a flange having an opening therethrough and an conduit retainer, such as a cylinder for the attachment of a conduit. An opening or aperture may be cut in a partition and a partition coupling may be secured over the opening to the exterior surface of the partition by fastening the flange to the partition. A conduit may then be attached to the conduit retainer of the partition coupling to allow airflow from the environment control device to flow into the enclosure through the opening in the partition. In some embodiments, two openings or holes are cut in a partition and an air inflow conduit and air outflow conduit are attached. In this manner, air flow from the environment control device flows into the enclosure and air from the enclosure is returned to the environment control device.

A partition coupling may comprise a flange retainer having a flange slot for receiving a conduit flange. For example, an opening maybe cut in an enclosure partition, or wall, and a partition coupling may be attached over said partition opening with a partition conduit inserted into the partition opening. The flange retainer may comprise one or more fastener openings whereby a nail, screw or other suitable fastener may be used to attach the partition coupling to the partition. A flange slot may have a slot opening on one or more sides of a flange retainer. A slot opening allows for the insertion of a conduit flange into the slot, whereby a conduit flange slides along the slot and is retained within the slot. A slot opening may be configured on a bottom side of a partition coupling whereby rain, ice and other debris will not collect in the flange slot. A partition coupling may further comprise a flange lock having a spring means, whereby the flange lock is configured to be compressed during insertion of the flange into the flange slot, and thereafter to protrude out to retain the flange. Any suitable type of spring means may be used with the flange lock including, but not limited to, a spring, an elastic material, such as foam or elastomer, a living hinge and the like.

A conduit flange comprises a conduit flange that extends outward from a flange conduit. A conduit, such as a flexible hose, may be attached to a flange conduit in any suitable manner. In an exemplary embodiment, a conduit is slid over a flange conduit, such as a cylinder, and attached with a hose clamp, for example. The conduit flange has a larger outer diameter, or larger outer dimension than the flange conduit, thereby allowing the conduit flange to fit within the flange slot and retain the conduit flange in the flange lock.

A conduit, as described herein, comprises an inlet end and an outlet end and at least one conduit flange. A conduit flange may be configured on both the inlet end, for insertion into the conversion cover flange retainer, and the outlet end, for insertion into the flange retainer of the partition coupling. The conduit flanges may be the same or different in shape and/or size. A conduit may be any suitable type of conduit for the transfer of airflow through the conduit opening. A conduit may comprise a plastic, metal, rubber, fabric or composite tube or hose and may be a composite, such as a wire enforced plastic or rubber hose. A conduit may be insulated to reduce heat transfer between the air within the conduit and the outside air. An insulating layer, such as foam or fabric may be configured around the exterior portion of the conduit. The conduit may have any suitable length, such as more than about 0.5 m, more than about 1 m, more than about 3 m, more than about 5 m, more than about 10 m, more than about 20 m and any range between and including the length values provided. Likewise, a conduit, as described herein, may have any suitable maximum inner dimension, such as diameter, including, but not limited to, more than about 5 cm, more than about 10 cm, more than about 20 cm, more than about 50 cm, more than about 75 cm and any range between and including the dimensions provided.

An environment control system, as described herein, may comprise an interior coupling comprising an insert portion configured to extend into a partition opening and a partition cover portion. The insert portion is configured to overlap the partition conduit and the overlapping portion of the insert portion may be configured to fit within the partition conduit or around the partition conduit. In a preferred embodiment, the insert portion is cylindrical in shape and overlaps a partition conduit that is also cylindrical in shape by fitting around the partition conduit, whereby the inner diameter of the insert portion, in the overlapping area, is larger than the outer diameter of the partition conduit. The variable amount of overlap of the partition conduit and the insert portion allows for coupling the two components across partitions of various thickness. For example, a thinner partition would require more overlap such that the partition cover fits against the interior wall of the partition, whereas a thicker partition would require less overlap. A partition cover portion is configured to extend out from the insert portion thereby creating a flange that is configured to rest against the interior surface of a partition. A partition cover comprises at least one opening and preferably a plurality of openings. In one embodiment, a partition cover comprises a louvered face and an interior control that can be used to adjust the amount of open area in the partition cover, or the direction of airflow from the interior coupling. An interior control may be linked to the partition cover openings, such as the louvers, and adjust the amount of open area in any suitable way. In addition, an interior coupling may be rotated to further adjust the direction of airflow.

An environment control system, as described herein, may further comprise a partition flange cover that may be inserted into the partition flange slot and close-off the opening in the partition coupling. The flange cover may substantially reduce airflow through the partition coupling opening and prevent rain, ice, debris and animals from entering into the enclosure.

An environment control device may be converted to a portable environment control device for an enclosure as described herein through the following steps: providing an environment control system, as described herein; attaching a conversion cover to the environment control device by securing the at least one cover retainer; attaching the inlet end of the conduit to the cover coupling; attaching the partition coupling to a partition, over a partition opening; whereby the partition conduit portion is inserted into the partition opening; attaching the outlet end of the conduit to the flange retainer by inserting the conduit flange into the flange slot; inserting the interior coupling over the partition conduit portion; and turning on the environment control device to provide airflow from the environment control device through the partition.

In an embodiment of the method of converting an air-conditioner, as described herein, the environment control device is a window-unit type air-conditioner. In another embodiment of the method of converting an air-conditioner, as described herein, the conversion cover comprises a control opening, whereby at least one control of the environment control device can be manipulated with the conversion cover attached to the outlet airflow face of the air-conditioner. In another embodiment of the method of converting an air-conditioner, as described herein, the cover coupling comprises a cover flange retainer having a flange slot configured for receiving a conduit flange, and wherein the conduit is attached to the conversion cover by sliding the conduit flange into the flange slot of the cover flange retainer.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
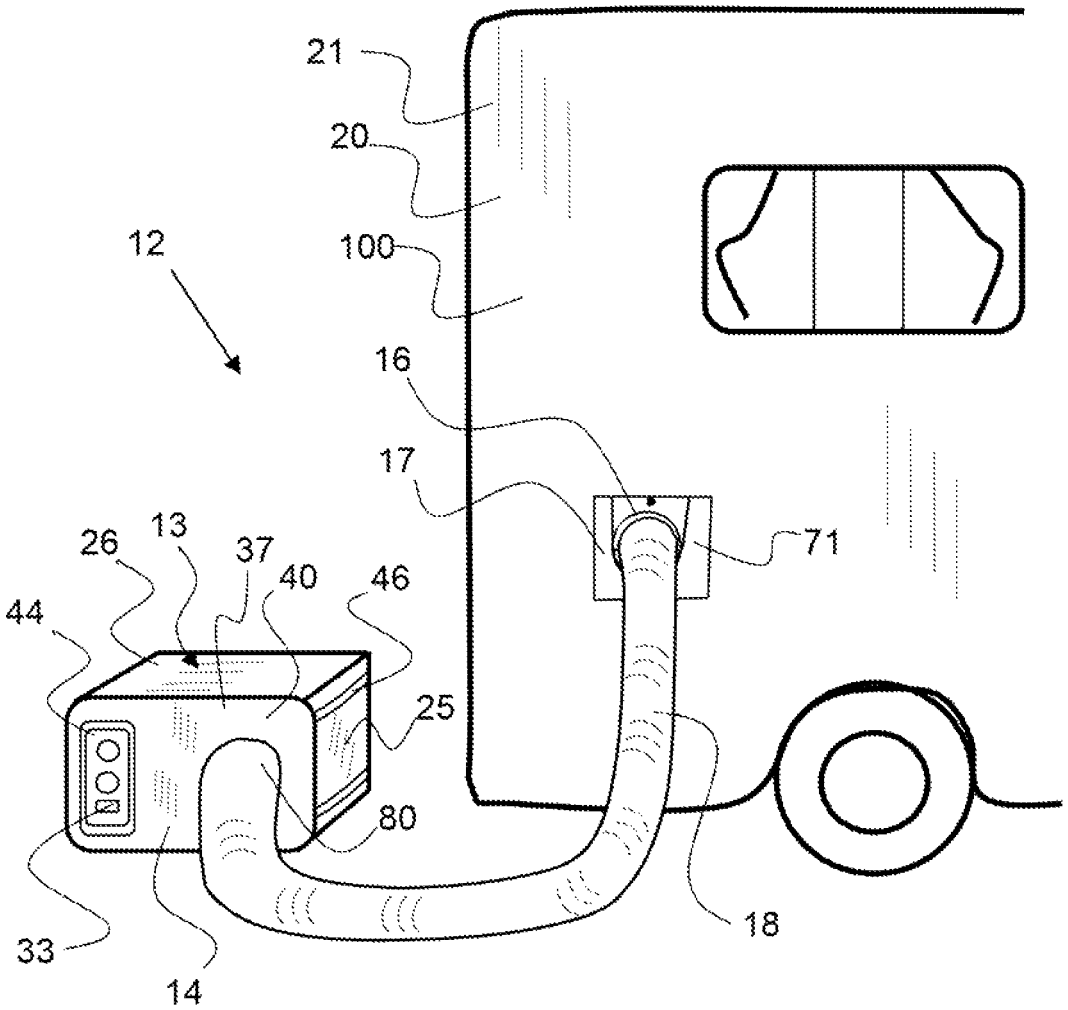
FIG. 1 shows and isometric view of an exemplary environment control system attached to recreational vehicle.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

DEFINITIONS

The term environment control system may be used to describe the portable environment control system herein. The environment control system, as describe herein, is portable because it easily transported from one location to another and is quick and easy attach it to a partition of an enclosure. It is envisioned that a user may attach partition couplings to two or more enclosures and use the portable environment control system to periodically cool these enclosures. A partition flange cover may be inserted into a partition coupling when the portable environment control system is not attached.

A partition coupling may comprise any suitable type of coupling for connecting a conduit and allowing air flow to pass from the conduit through an opening in a partition. A partition coupling is configured to be attached over an opening in a partition. A partition coupling may comprise a conduit coupling that is a cylinder or other extension whereby a conduit may be slid over the extension and attached, or may comprise a partition flange retainer configured for retaining a conduit flange.

As shown if FIG. 1, an environment control system 12 is attached to a recreational vehicle 21. An environment control device 13 is configured outside of the recreational vehicle and comprises a conversion cover 14 on the outlet airflow face 37 of the air-conditioner 26. The conversion cover comprises a control opening 44 in the cover panel 40 whereby the controls 33 of the air-conditioner may be manipulated without removal of the conversion cover panel. The conversion cover is attached to the environment control device by a plurality of straps 46 that extend from the cover panel 40 to the back of the air-conditioner. The inlet end 80 of the conduit 18 is attached to the conversion cover and the outlet end 82 is attached to the partition coupling 17. The conduit flange 16, attached to the outlet end of the conduit, is retained in the flange retainer 71. The environment control system as shown in FIG. 1 is capable of providing cool air to the interior of the enclosure 20, or recreational vehicle 21 as shown.

Figure 2A:
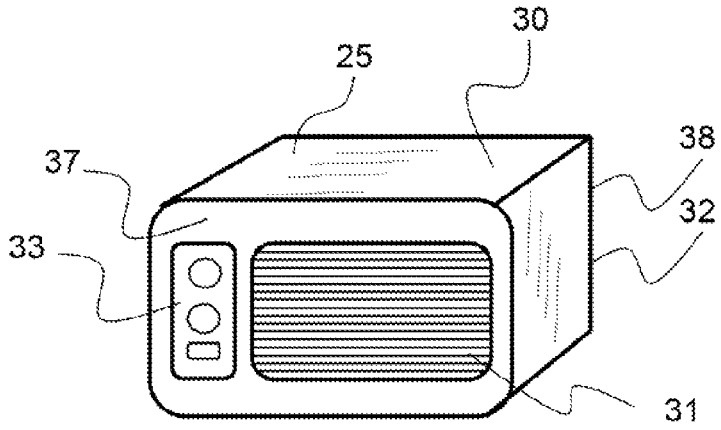
FIG. 2A shows an isometric view of a window-unit type environment control device having an outlet airflow face and controls.

As shown in FIG. 2A, a window-unit type air-conditioner 30 has an outlet airflow face 37 comprising an air outlet opening 31 and controls 33 on the same face. The controls 33 may be any suitable controls, such as an on/off control, a temperature control, and/or an air-flow control. The air inlet 32 is configured on the backside 38 of the air-conditioner, as shown. In some embodiments, the air inlet or intake is configured on the side, top or front of the air-conditioner.

Figure 2B:
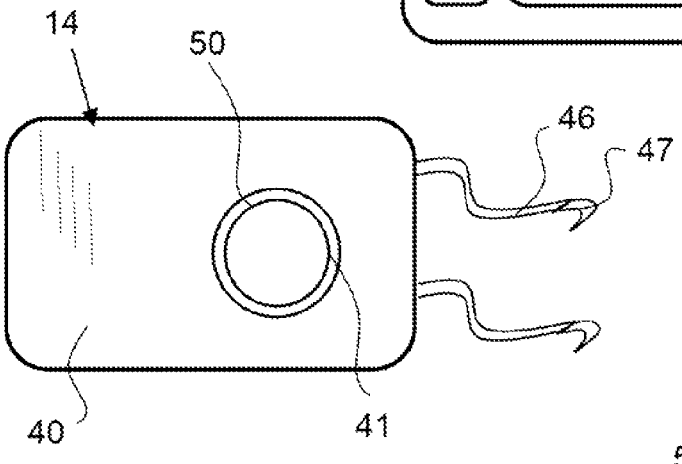
FIG. 2B shows a front view of an exemplary conversion cover.

As shown in FIG. 2B, a front view of an exemplary conversion cover 14 has an air outlet opening 41 in the cover panel 40 and a plurality of cover retainers 47, straps 46, with a clip on the end. A cover retainer can comprise any suitable attachment device including, but not limited to a clip, fastener, magnet or combination of attachment devices.

Figure 2C:
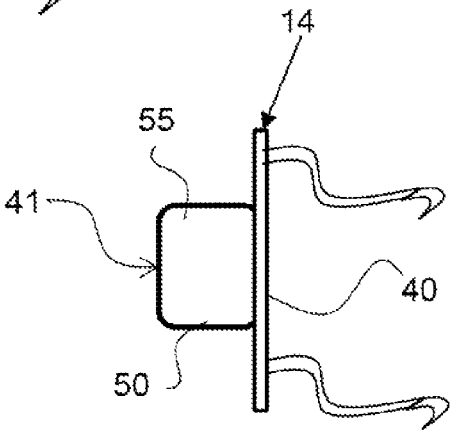
FIG. 2C shows a side view of an exemplary conversion cover.

As shown in FIG. 2C, a side view of an exemplary conversion cover 14 comprises cover panel 40 having a conduit retainer 55 extending out from the cover panel. The conduit retainer 55 is a cylinder, and just one example of a type of cover coupling 50. A conduit may be slid over the cylinder and retained by any suitable means including a hose clamp, elastic band, tape and the like.

Figure 2D:
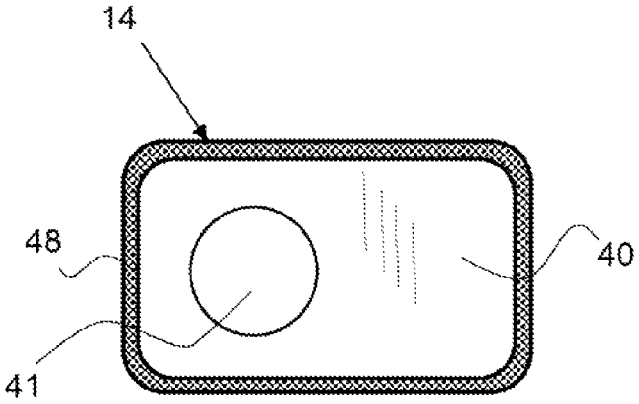
FIG. 2D shows a back view of an exemplary conversion cover.

As shown in FIG. 2D, a back view of an exemplary conversion cover 14 comprises an air outlet opening 41 and a seal 48 configured around the perimeter of the cover panel 40.

Figure 3:
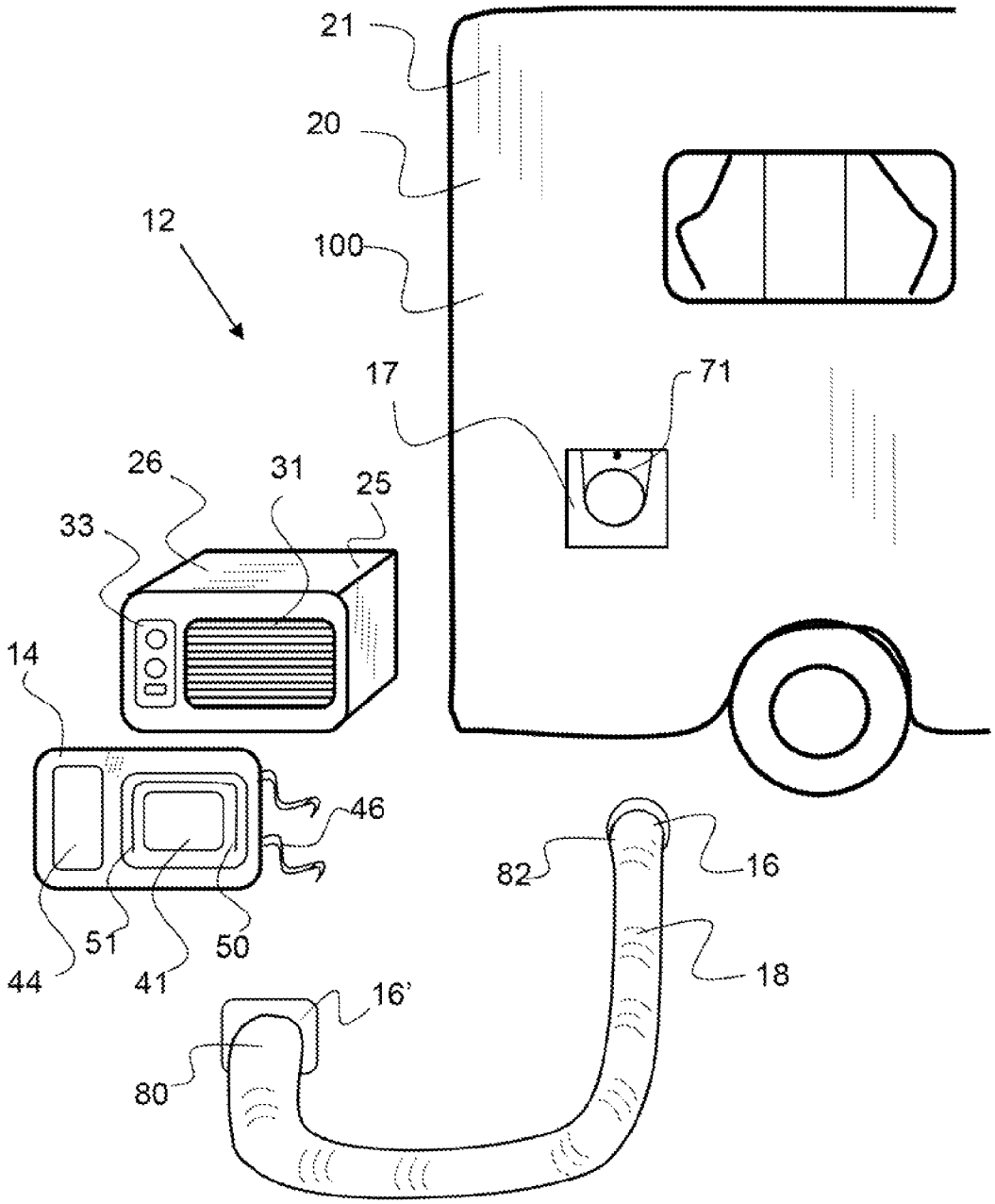
FIG. 3 shows an isometric view of an exemplary environment control system with the conduit and conversion cover detached.

As shown in FIG. 3, an exemplary environment control system 12 comprises a conduit 18 having a flange 16 on the outlet end 82 and a flange 16' on the inlet end 80. The conduit flanges are configured to be inserted into the slots of the partition flange retainer 71 and the cover flange retainer 51. The conversion cover 14 is shown detached from the environment control device 13 and has a control opening 44, an air outlet opening 41 and cover flange retainer 51 type cover coupling 50. The flange 16' is configured to be slid into the cover flange retainer 51. The partition coupling is shown attached to the partition 100.

Figure 4A:
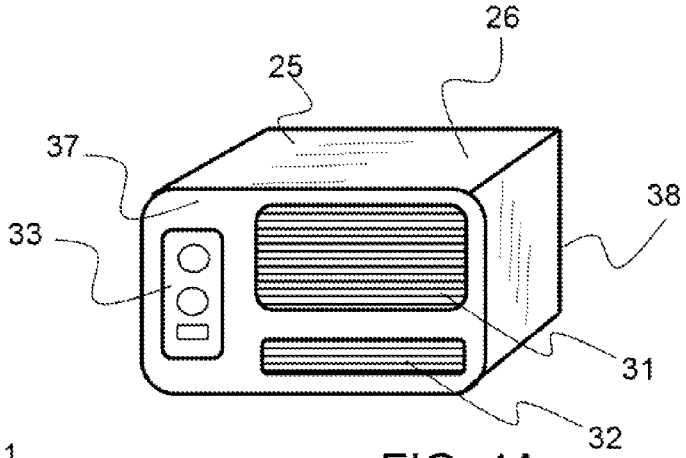
FIG. 4A shows an isometric view of an exemplary environment control device comprising an air inlet on the same face as the outlet airflow face.

As shown in FIG. 4A, an exemplary environment control device 25 comprises an air inlet 32 on the outlet airflow face 37 of the air conditioner 26.

Figure 4B:
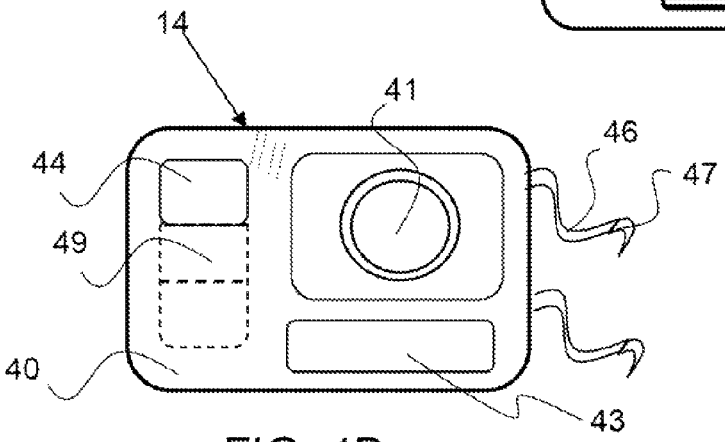
FIG. 4B shows a front view of an exemplary conversion cover having an air outlet and an air inlet opening.

As shown in FIG. 4B, an exemplary conversion cover 14 has an air outlet opening 41 and an air inlet opening 43. In addition, the cover panel 40 comprises break-out portions 49, shown in dashed lines, whereby a user can pop-out portions of the panel to have access to environment control device controls. As shown in FIG. 4B only one break-out portion has be removed to provide a control opening 44 in the cover panel 40. A break-out panel may comprise a portion of the cover panel having scored, perforated or otherwise weakened material, whereby exerting force on these portions causes the break-out portion to detach from the cover panel.

Figure 4C:
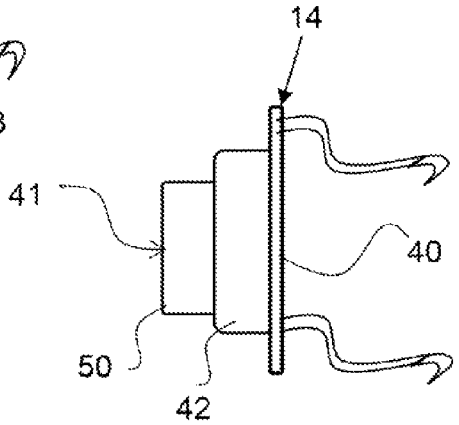
FIG. 4C shows a side view of an exemplary conversion cover having an outlet manifold.

As shown in FIG. 4C, an exemplary conversion cover 14 has an outlet manifold 42, whereby a reduced area air outlet opening 41 is configured at some distance from the cover panel 40. An outlet manifold 42 may enhance air flowing through the conversion panel by providing a graduated area reduction from the air outlet opening 31 of the air conditioner to the air outlet opening 41 in the cover panel 40. An outlet manifold may have any suitable geometry including graduated as shown in FIG. 4C, or continuous, whereby the reduction in area is linear from the air outlet opening of the air condition to the air outlet opening 41 of the control panel.

Figure 4D:
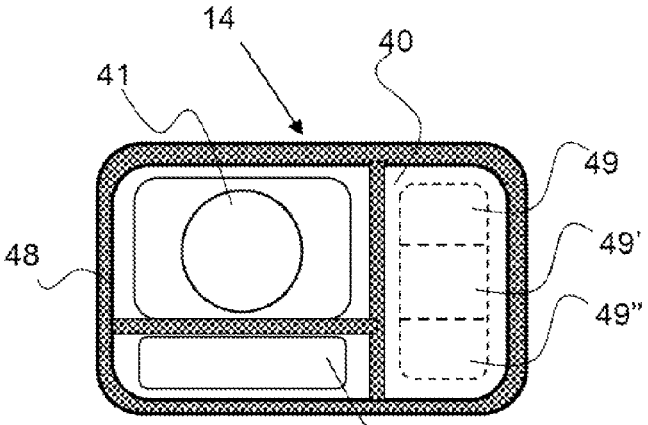
FIG. 4D shows a back view of an exemplary conversion cover having a seal and break-out portions.

As shown in FIG. 4D, an exemplary conversion cover 14 has a seal 48 configured around the air outlet opening 41, a seal around the control portion of the cover panel 40 having break-out portions 49-49" and a seal around the air inlet opening 43.

Figure 5A:
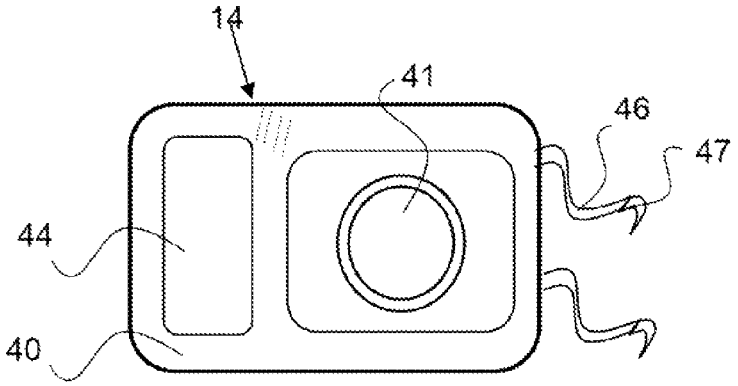
FIG. 5A shows a front view of an exemplary conversion cover having an air outlet and a control opening.

As shown in FIG. 5A, an exemplary conversion cover 14 has an air outlet opening 41 and a control opening 44.

Figure 5B:
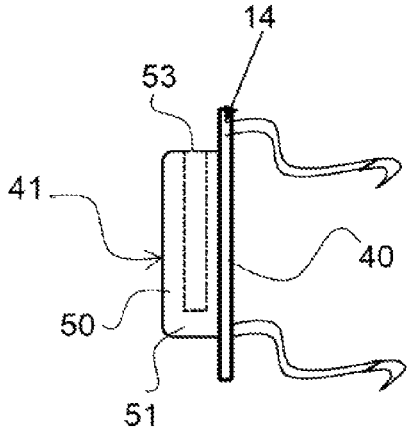
FIG. 5B shows a side view of an exemplary conversion cover having a cover flange retainer type cover coupling.

As shown in FIG. 5B, an exemplary conversion cover 14 has a cover flange retainer 51 type cover coupling 50. The flange slot 53 is configured in the top side of the cover panel 14. The flange slot may however be oriented in any side of the cover panel, such as on a side or bottom.

Figure 5C:
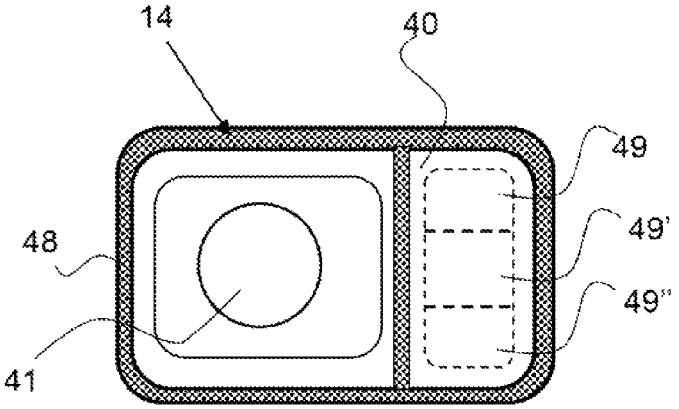
FIG. 5C shows a back view of an exemplary conversion cover having a seal and break-out portions.

As shown in FIG. 5C, an exemplary conversion cover 14 has a seal 48 and three break-out portions 49-49". The break-out portions are provided to allow variability in the size of the opening needed for manipulation of the environment control device controls.

Figure 6A:
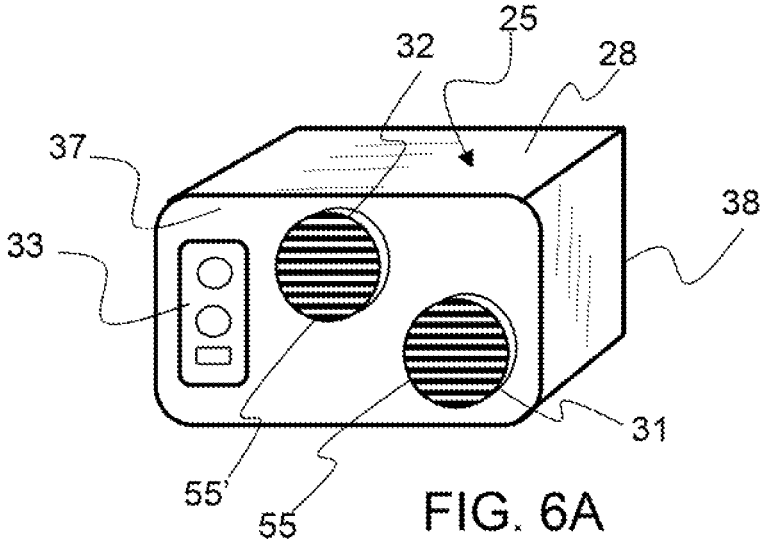
FIG. 6A shows an isometric view of an exemplary environment control device comprising an air inlet and an air outlet the outlet airflow face.

As shown in FIG. 6A, an exemplary environment control device 25 comprises an air inlet 32 and an air outlet 31 on the outlet airflow face 37. Furthermore, both the air inlet 32 and air outlet 31 are configured with a conduit retainer 55', 55 respectively. This exemplary environmental control device allows for the direct attachment of an air inlet and air outlet conduit. The conduit retainers 55,55' are cylinders that extend out from the outlet airflow face 37. The air inlet and air outlets may be configured on any side of the environment control device. In this embodiment, the environment control device is a heat-pump 28. Any environment control device as describe herein may have an air inlet, an air outlet, both an air inlet and outlet, and any air passageway may be configured with a conduit retainer 55.

Figure 6B:
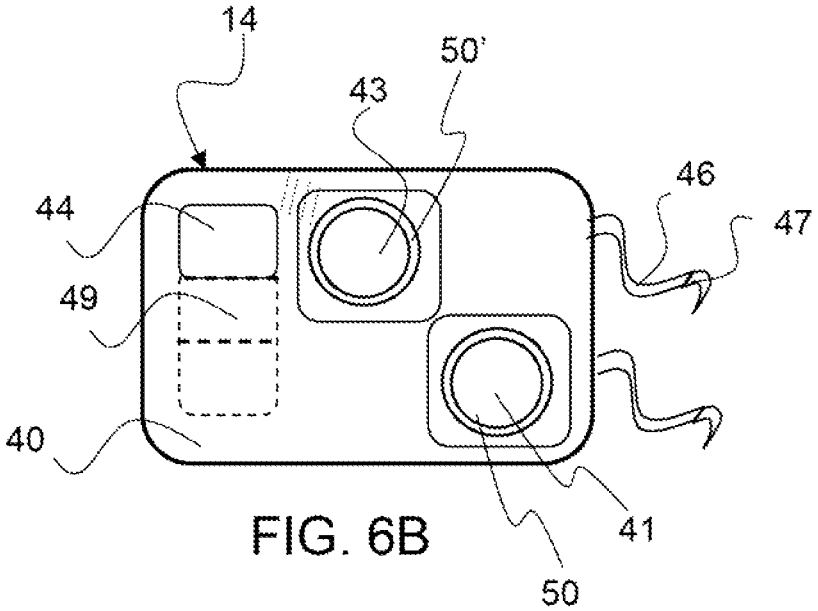
FIG. 6B shows a front view of an exemplary conversion cover having an air outlet and an air inlet opening.

As shown in FIG. 6B, an exemplary conversion cover 14 comprises an air outlet 41 and an air inlet 43 opening. This conversion cover may be configure to fit over the environment control device 13 shown in FIG. 6A. The conversion cover 14 comprises a cover coupling 50 for the air outlet conduit and a cover coupling 50' for the air inlet conduit.

Figure 7:
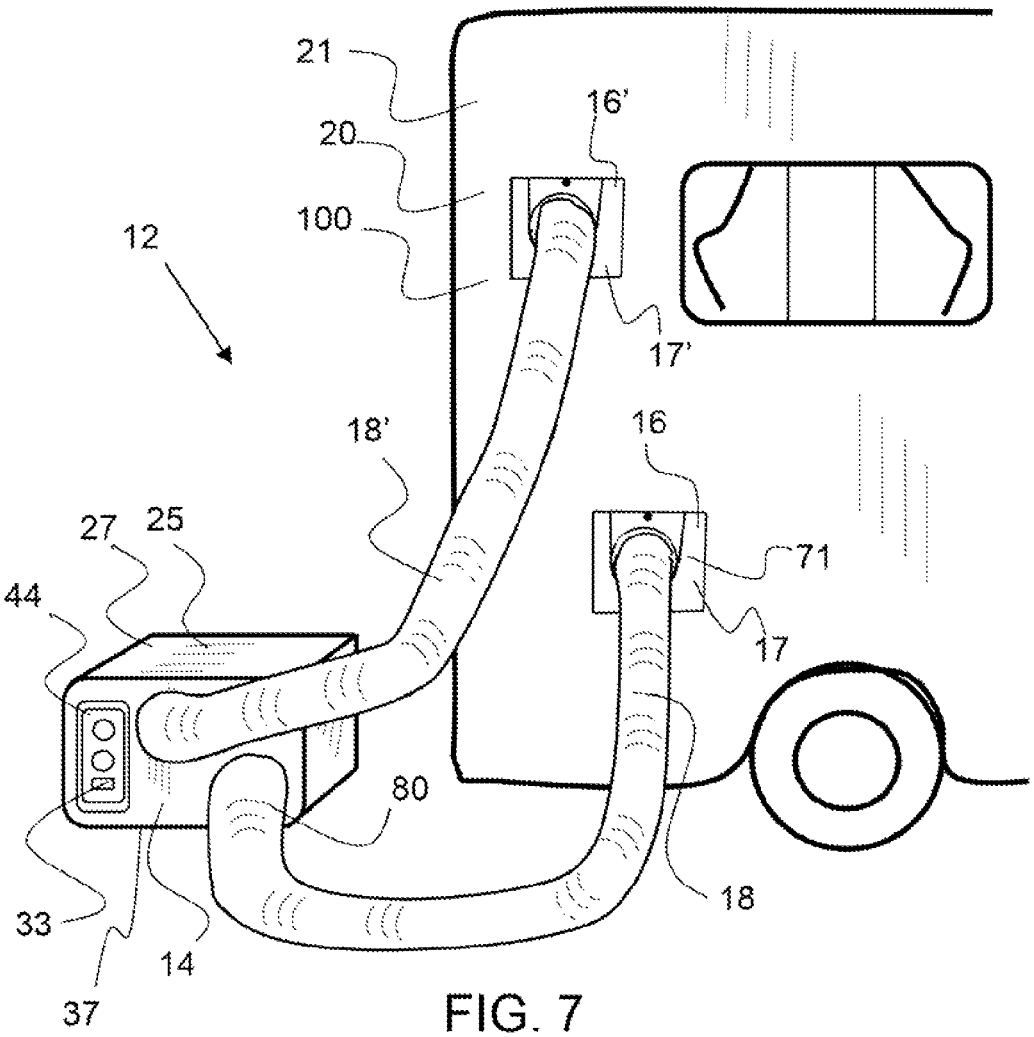
FIG. 7 shows and isometric view of an exemplary environment control system having an air inlet conduit and air outlet conduit attached to recreational vehicle.

As shown in FIG. 7, an exemplary environment control system 12 comprises an air inlet conduit 18' and air outlet conduit 18 attached to recreational vehicle 21. The air outlet conduit 18 allows air flow from the environment control device 25 to flow into the enclosure 20, and the air inlet conduit 18' allows air from the enclosure to flow back to the environment control device. The environment control device 25 shown in FIG. 7 is a heater 27.

Figure 8:
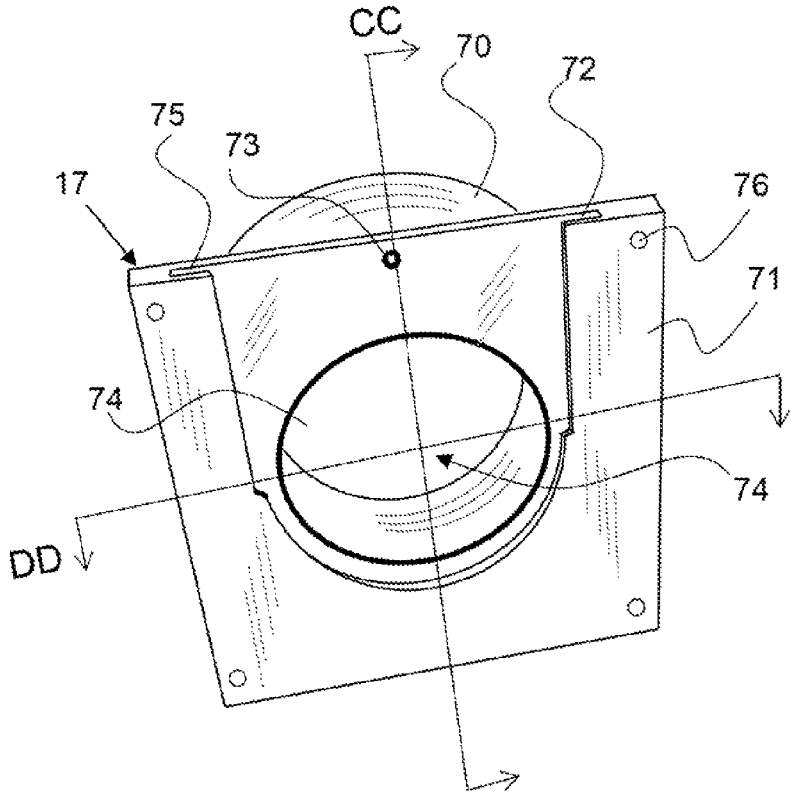
FIG. 8 shows an isometric view of an exemplary partition coupling.

As shown in FIG. 8, an exemplary partition coupling 17 comprises a partition conduit 70 and a partition flange retainer 71. A partition coupling opening 74 extends through the partition coupling 17. The partition flange retainer 71 comprises a flange slot 72 on either side of the partition coupling opening 74, and the slot extends down along either side of and around the partition coupling opening. A slot may encircle any suitable portion of the partition coupling opening 74 but must be disposed on at least two opposing sides of the partition coupling opening 74. The slot opening 75 is configured on the top side of the partition flange retainer 72 but may be configured on any side. For example, the slot opening may be configured on the bottom of the partition flange retainer, thereby more effectively preventing rain and water entry into the partition coupling opening 74. A plurality of fastener opening 76 are configured around the outer perimeter of the partition flange retainer 71 for attachment to a partition, with screws for example. A flange lock 73 is shown configured on the slot opening side of the partition flange retainer, thereby when a conduit flange is inserted into the slot, the flange lock will prevent the conduit flange from sliding freely out of the flange slots 72. The flange lock may comprise a spring means, whereby the conduit flange compresses the flange lock while it is being inserted and thereafter the flange lock springs out to prevent the flange from sliding out. A cover flange retainer, may comprise a flange comprising, the flange slot 72, slot opening 75, partition conduit 70, and flange retainer 72 as shown in FIG. 8.

Figure 9:
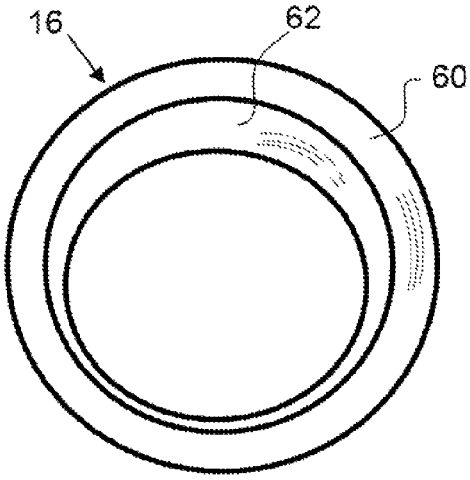
FIG. 9 shows an isometric view of an exemplary conduit flange.

As shown in FIG. 9, an exemplary conduit flange 16 comprises a conduit flange 60 that extends out from the flange conduit 62. A conduit may be slid over or inside of the flange conduit and attached with any suitable means as described herein.

Figure 10:
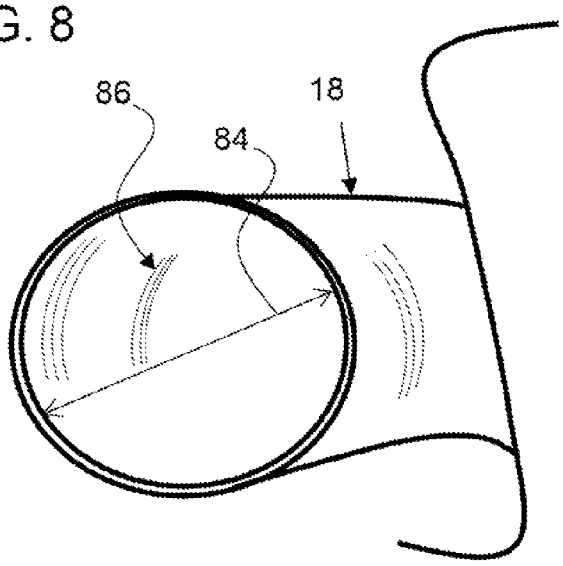
FIG. 10 shows an isometric view of an exemplary conduit.

As shown in FIG. 10, an exemplary conduit 18 comprises a flexible hose having a conduit opening 86 therethrough and a maximum inner dimension 84 that is the maximum linear dimension as measured across the conduit opening. A conduit 18 may have any suitable opening shape, such as round or circular, square, rectangular, polygonal, irregularly shaped and the like.

Figure 11:
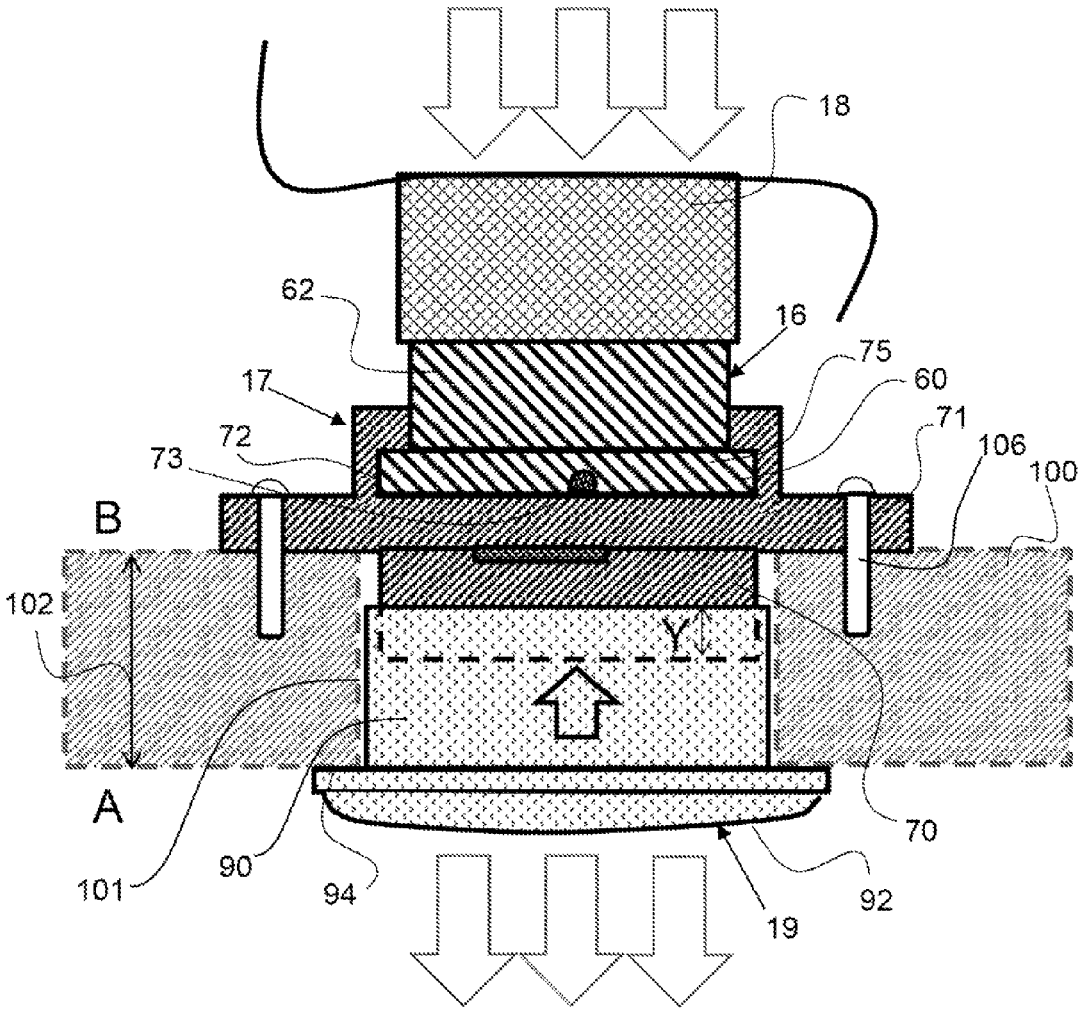
FIG. 11 shows a top down cross-sectional view of the exemplary partition coupling shown in FIG. 8 taken along line DD, a conduit flange and interior coupling attached.

As shown in FIG. 11, the top down cross-sectional view of the exemplary partition coupling 17 shown in FIG. 8 and taken along line DD, has a partition flange retainer 71 that is fastened to the partition 100 with fasteners 106. The partition conduit 70 is inserted into the partition opening 101. The conduit flange 60 of the conduit flange 16 is inserted into the flange slot 72 thereby substantially sealing the conduit flange to the partition flange retainer 71. The conduit 18 is shown attached to the flange conduit 62. The flange lock 73 is shown extended out to prevent the conduit flange 16 from sliding out of the slot opening 75. The interior coupling 19 is shown with the insert portion 90 inserted around the partition conduit 70 thereby creating an overlap region with an overlap dimension of Y. The overlap configuration of the insert portion and the partition conduit allows for adjustment of the interior coupling to the width of the partition 102. The exterior surface, or outside surface, of the partition is the B side and the interior surface, or inside surface, of the partition is the A side as shown in FIG. 11. Airflow is represented in FIG. 11 by the three large arrows moving into the conduit 18 and flowing out of the partition cover portion 92. The partition cover portion 92 has a partition cover flange 94 that extend out and is configured to be flush with the inside surface, surface A, of the partition 100.

Figure 12:
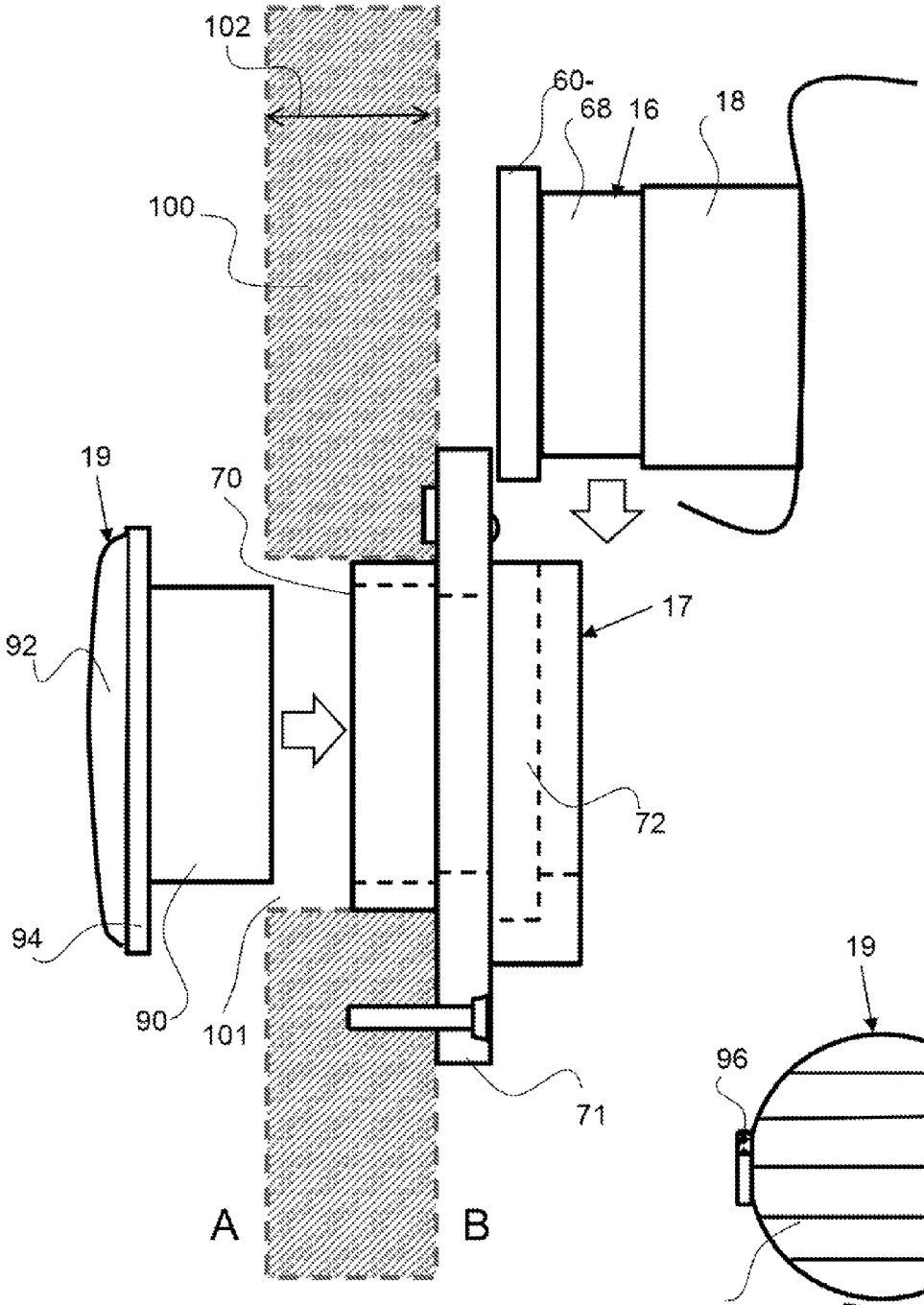
FIG. 12 shows a side cross-sectional view of the exemplary partition coupling shown in FIG. 8 taken along line CC, a conduit flange and interior coupling.

As shown in FIG. 12, a side cross-sectional view of the exemplary partition coupling 17 taken along line CC of FIG. 8, is inserted into the partition opening 101. The conduit flange 60 is poised above the flange slot 72 to be slid down through the slot opening. The interior coupling 19 is shown being inserted (large arrow) into the partition opening 101, and into the partition conduit. In this embodiment, the insert portion 90 is configured to be inserted into, versus around, the partition conduit 70. Furthermore, the interior coupling may be rotated as indicated by the arced arrow to further adjust and select airflow direction.

Figure 13:
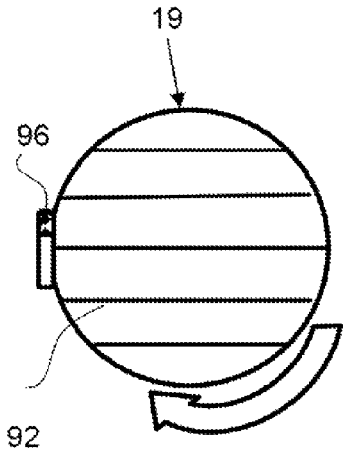
FIG. 13 shows a front view of an exemplary interior coupling cover panel.

As shown in FIG. 13, an exemplary interior coupling 19 comprises a partition cover portion 92 having a plurality of louvered openings as indicated by the horizontal lines. In addition, the interior coupling comprises an interior control 96, whereby the opening dimension, and/or direction of airflow may be controlled.

Figure 14A:
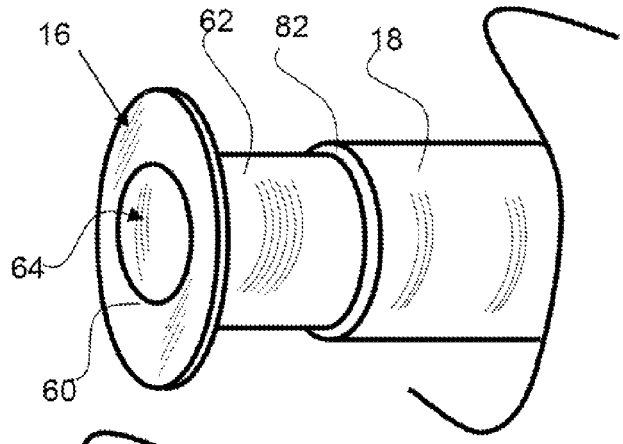
FIG. 14A shows an exemplary conduit flange.
Figure 14B:
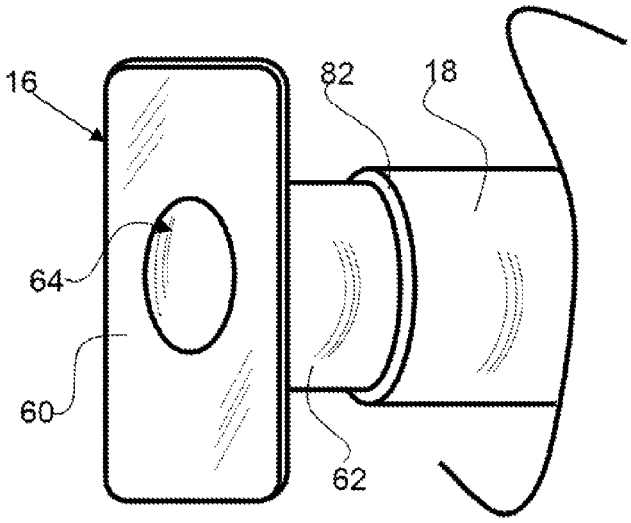
FIG. 14B shows an exemplary conduit flange.

As shown in FIG. 14A, an exemplary conduit flange 16 has a conduit flange 60 that is circular in shape and comprises a flange opening 64. As shown in FIG. 14B, an exemplary conduit flange 16 has a conduit flange 60 that is rectangular in shape.

Figure 15A:
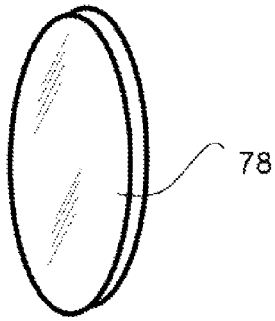
FIG. 15A shows an exemplary flange cover.
Figure 15B:
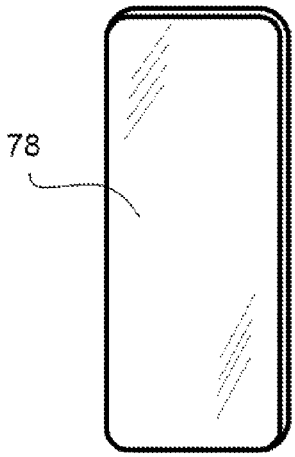
FIG. 15B shows an exemplary flange cover.

As shown in FIG. 15A a flange cover 78 has a circular shape. As shown in FIG. 15B a flange cover 78 has a rectangular shape. Flange covers may be inserted into flange slots when the portable air conditioning system in not being used or in some cases during transport of the enclosure. A flange cover may be inserted into a flange slot of a partition coupling or a flange slot of a cover coupling.

Figure 16:
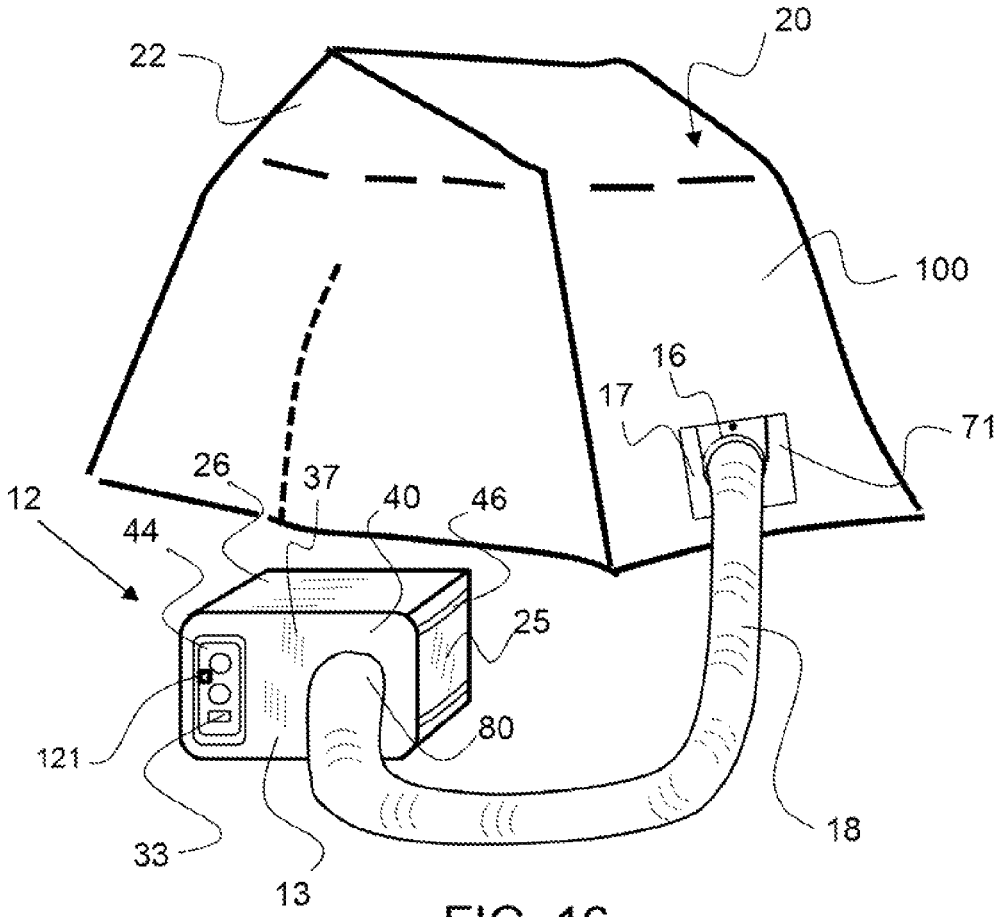
FIG. 16 shows and isometric view of an exemplary environment control system attached to tent.

As shown in FIG. 16, an environment control system 12 is attached to a tent 22. An environment control device 13 is configured outside of the tent and comprises a conduit 18 extending from the environment control device to the partition coupling 17. The inlet end 80 of the conduit 18 is attached to a conduit retainer 55 and the outlet end 82 is attached to the partition coupling 17. The conduit flange 16, attached to the outlet end of the conduit, is retained in the flange retainer 71. The environment control system, and air conditioner 26, as shown in FIG. 16, is capable of providing cool air to the interior of the enclosure 20, or tent 22 as shown. The partition 100 of the tent is flexible and the partition coupling 17 as shown is made of a flexible material, such as rubber to allow flexibility with the partition material. The environmental control device 13, or air conditioner 26 is this example, is a discrete and portable type of environmental control device in that it is not affixed or attached to dwelling or structure, and is of a size that can be carried by hand from one location to another by a single person. In one embodiment, a discrete and portable environment control device has no dimension greater than 36 inches for example, including length, width and height.

Figure 17:
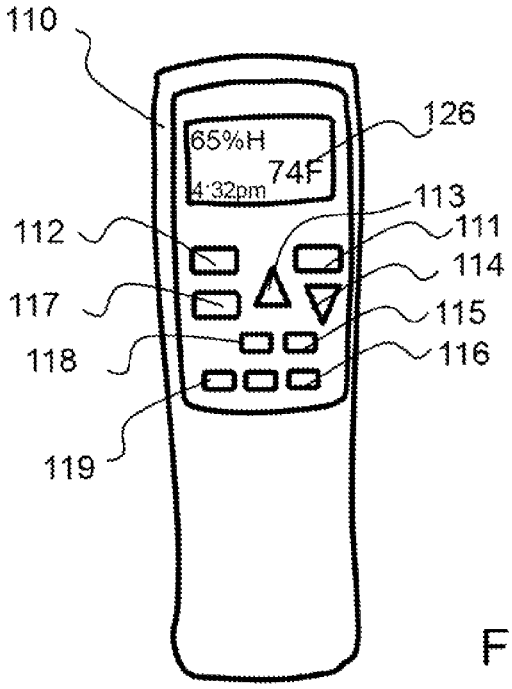
FIG. 17 shows a front view of an exemplary remote control.

As shown in FIG. 17, a remote control 110 may be configured to send a wireless signal to control environmental control system. The remote controller may be configured to turn the environmental control system on or off, increase the output, including the temperature within an enclosure that the environmental control system is couple with. The remote control may have a temperature sensor 123 that monitors the temperature and/or humidity within the enclosure. A user may set a desired temperature or humidity setting and the remote control may automatically send a control signal to the environmental control system when the condition, temperature or humidity, falls outside of the user set point. For example, an environmental control system may employ an air conditioning unit and the user may set a temperature of 72 degrees on the remote control. When the temperature in the enclosure, such as a shed, the remote control sends a control signal to the environmental control system, which is received by a wireless signal receiver 121, as shown in FIG. 16. A wireless receiver may be coupled with a controller of the environmental control device. In this example, the control signal may direct the air conditioning unit to turn on and cool the shed. A remote control 110 may have any number of various user input functions, such as an on/off 111, temperature control up 113, temperature control down 114, a mode input 112, such as heat, cool, or humidity control, fan control 117, sleep mode 118, timer controller 116, time input 119, such as hour/min, and a reset input 115. A display screen 126 may provide a user with a current reading of the temperature and/or humidity and may allow input and control readouts for setting various functions or inputs, including a time and or control schedule.

In one embodiment, a window unit type air-conditioner is converted to an environmental control system as described herein by following the method comprising the steps of: removing the existing cover or front panel from the air-conditioner; attaching a conversion cover to the air-conditioner; attaching a first end of a conduit to the conversion cover; attaching the second end of the conduit to a partition coupling, whereby airflow from the air-conditioner flows through the conduit and into the enclosure. A conversion cover may be specifically designed for an air-conditioner or other environment control device such that conduits for airflow do not create too much resistance to flow. For example, the size of the conduits or conduit opening on a conversion cover may be sized to allow the environmental control device to operate within standard limits. In addition, a standard environmental control device, such as an air-conditioner may be further modified including modification or changing of motor and fans, or motor or fan speeds or power output.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An environment control system comprising:

a. an environment control device comprising:
   i. an air outlet;

b. at least one partition coupling comprising:
   i. a conduit coupling;

c. at least one conduit having:
   i. an inlet end;
   ii. an outlet end;

d. a conversion cover comprising:
   iii. a cover panel;
   iv. a cover coupling;
   v. an air outlet opening; and
   vi. cover retainer;
   wherein the conversion cover is configured to cover at least the air outlet opening of the environment control device;
   wherein the cover coupling comprises a cover flange retainer having a flange slot configured for receiving a conduit flange;
   whereby the environment control device produces an outlet airflow that passes through the air outlet,
   wherein the conduit is configured to extend from the air outlet to the partition coupling, and
   whereby the outlet airflow is directed through the conduit, the partition coupling, through a partition opening and into an enclosure.

2. The environment control system of claim 1, wherein the at least one partition coupling comprise a partition conduit configured for insertion into the partition opening wherein the partition conduit is configured to extend at least partially through said partition opening and comprises an opening for the flow of air through said partition coupling.

3. The environment control system of claim 1, wherein the at least one partition coupling comprise:

a. a flange retainer comprising:

b. a flange slot having a slot opening on one side of the partition coupling wherein the at least one conduit comprises at least one conduit flange configured for insertion into said flange slot, and wherein the conduit flange is configured to align with said partition coupling.

4. The environment control system of claim 1, wherein said environment control device is an air-conditioner.

5. The environment control system of claim 1, wherein said environment control device is a heater.

6. The environment control system of claim 1, wherein said environment control device is a heat-pump.

7. The environment control system of claim 1, wherein said environment control device is a dehumidifier.

8. The environment control system of claim 1, wherein the conversion cover comprises at least one break-out portion, whereby the break-out portion may be detached to provide access to an environment control device control.

9. An environment control system comprising:

a. an environment control device comprising:
  i. an air outlet;

b. at least one partition coupling comprising:
  i. a conduit coupling;

c. at least one conduit having:
  i. an inlet end;
  ii. an outlet end;
  whereby the environment control device produces an outlet airflow that passes through the air outlet,
  wherein the conduit is configured to extend from air outlet to the partition coupling, and
  whereby the outlet airflow is directed through the conduit, the partition coupling, through a partition opening and into an enclosure;
  wherein the at least one partition coupling comprise:
    a flange retainer comprising:
    a flange slot having a slot opening on one side of the partition coupling;

wherein the at least one conduit comprises at least one conduit flange configured for insertion into a flange slot, and
  wherein the conduit flange is configured to align with said partition coupling;
  wherein the partition coupling further comprises a flange lock comprising a spring means, whereby the flange lock is configured to be compressed during insertion of the conduit flange into the flange slot and protrude out to retain the conduit flange in the flange slot after insertion of the conduit flange.

10. The environment control system of claim 1, wherein the conduit comprises a conduit flange on both the inlet end and outlet end.

11. The environment control system of claim 3, further comprising an insert plate configured for insertion into the flange slot whereby airflow through the partition coupling may be blocked when the conduit flange is not inserted into the flange slot.

12. The environment control system of claim 1, wherein the environment control device further comprises:

a. an air inlet
b. an outflow partition coupling;
c. a second conduit;

wherein the outflow partition coupling is configured for air outflow from said enclosure to the environment control device through the second conduit.

13. The environment control system of claim 1, further comprising a remote controller configured to send a wireless signal that controls at least one function of the environment control device.

14. A method of converting an environment control device to a portable environmental control system comprising the steps of:

a. providing a plurality of environment control system components comprising:
  i. a conversion cover comprising:
    a cover panel;
    an air outlet opening;
    at least one cover retainer; and
    a cover coupling;
  ii. a partition coupling comprising:
    a partition conduit;
    an interior coupling;
    a flange retainer comprising:
      a flange slot having a slot opening on one side of the partition coupling;
  iii. a conduit comprising:
    an inlet end;
    an outlet end;
    at least one conduit flange configured for insertion into the flange slot; and
  wherein the conversion cover is configured to at least partially cover an outlet airflow face of said environment control device,
  whereby an outlet flow from said environment control device is directed through the air outlet opening of said conversion cover,
  wherein the conduit is configured to extend from the cover coupling to the partition coupling,
  wherein the conduit is configured to align with said partition conduit when the conduit flange is inserted into the flange slot, and
  whereby a flow of air from the outlet airflow face of said environment control device is directed through said conduit, the partition conduit, the interior coupling and into an enclosure;

b. attaching the conversion cover over an air outlet of said environment control device by securing the at least one cover retainer;

c. attaching the inlet end of the conduit to the cover coupling;

d. attaching the partition coupling to a partition over a partition opening; whereby the partition conduit is inserted into the partition opening;

e. attaching the outlet end of the conduit to the flange retainer by inserting the conduit flange into the flange slot;

f. inserting the interior coupling over the partition conduit; and g. turning on the environment control device to provide an air flow from the environment control device through the partition and into the enclosure.

15. The method of converting an environment control device to a portable environmental control system of claim 14, wherein said environment control device is a discrete and portable air-conditioner.

16. The method of converting an environment control device to a portable environmental control system of claim 14, wherein the cover coupling comprises a cover flange retainer having a flange slot configured for receiving the conduit flange, and wherein the conduit is attached to the conversion cover by sliding the conduit flange into the flange slot of the cover flange retainer.

17. The method of converting an environment control device to a portable environmental control system of claim 14, wherein the conversion cover comprises at least one break-out portion, whereby the break-out portion is detached to provide access to an environment control device control.

18. The method of converting an environment control device to a portable environment control system of claim 14, wherein the environment control device further comprises:
  an air inlet; and a second conduit; and an outflow partition coupling;

wherein the outflow partition coupling is configured for air outflow from the enclosure to the environment control device, and whereby the method of converting an environment control device to a portable environmental control system further comprises the steps of attaching the second conduit from the outflow partition coupling to the air inlet of the environment control device.

* * * * *